US005131580A

United States Patent [19]

Allman

[11] Patent Number: 5,131,580

[45] Date of Patent: Jul. 21, 1992

[54] EMITTER GUN APPARATUS

[76] Inventor: Thomas Allman, 961 Gromore Rd., Yakima, Wash. 98908

[21] Appl. No.: 736,435

[22] Filed: Jul. 26, 1991

[51] Int. Cl.[5] ..... B25C 1/02

[52] U.S. Cl. ..... 227/132; 227/146

[58] Field of Search ..... 227/154, 140, 30, 31, 227/32, 132, 146, 152

[56] References Cited

U.S. PATENT DOCUMENTS

| | | | |
|---|---|---|---|
| 2,680,246 | 6/1954 | Rambo | 227/132 X |
| 3,586,231 | 6/1971 | Wilson | 227/132 X |
| 3,923,228 | 12/1975 | Leff et al. | 227/132 |
| 4,156,499 | 5/1979 | Frank | 227/132 |
| 4,225,075 | 9/1980 | Chi | 227/132 X |

*Primary Examiner*—Frank T. Yost
*Assistant Examiner*—Rinaldi Rada
*Attorney, Agent, or Firm*—Hugh E. Smith & Assoc.

[57] ABSTRACT

An apparatus for directing fluid emitters into an irrigation pipe is provided, wherein the emitter includes a magazine aligning the emitter nails in a longitudinally aligned parallel relationship, including a hammer operative through a piston to sequentially project emitter nails into an underlying pipe. The pipe is mounted upon a "J" shaped support anvil, wherein the anvil may optionally further include a foot member mounted upon a slide mounted to a forward wall of a housing of the apparatus to provide frictional retention of the pipe during assembly of the emitter nails and the pipe.

2 Claims, 5 Drawing Sheets

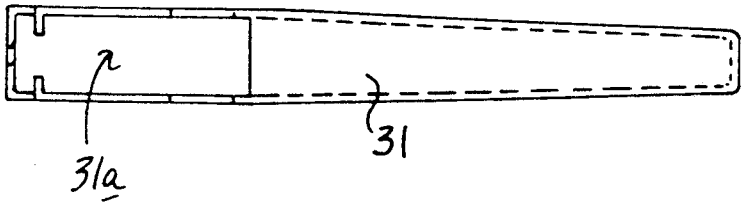
Fig 6
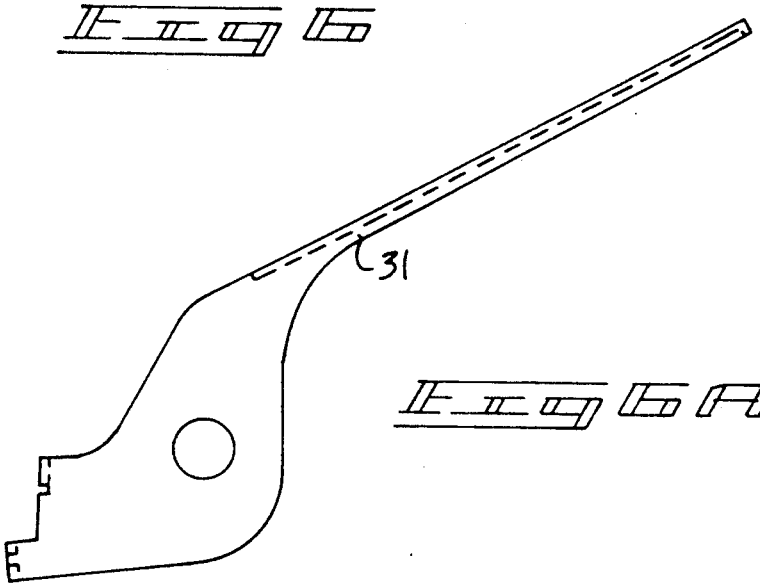
Fig 6A
Fig 7
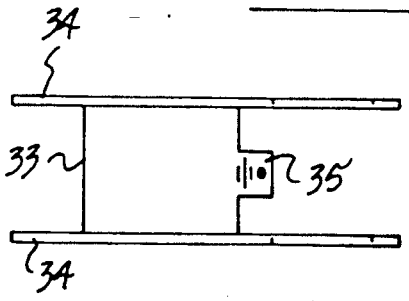
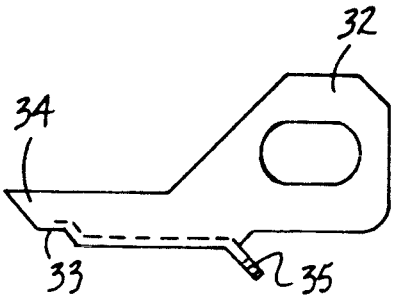
Fig 7A

EMITTER GUN APPARATUS

BACKGROUND OF THE INVENTION

1. Field of the Invention

The field of invention relates to nailing apparatus, and more particularly pertains to a new and improved emitter gun apparatus wherein the same is directed to project a fluid emitter into an irrigation pipe.

2. Description of the Prior Art

Various nailing guns are available in the prior art to project spike members into an associated workpiece or object. The instant invention utilizes a specialized emitter member configured as a nail to include a channel directed therethrough to permit flow of water from within an irrigation pipe the emitter nail is projected into. The specialized nature of the instant invention requires structure in a departure from prior art. Such prior art nailing guns are exemlified in U.S. Pat. No. 4,570,840 to Bull; U.S. Pat. No. 4,778,094 to Fishbach; U.S. Pat. No. 3,796,365 to Downing; U.S. Pat. No. 4,136,810 to Bull; and U.S. Pat. No. 4,815,647 to Chou. These prior art devices fail to provide particular accommodation for the specialized nail structure as utilized by the instant invention for projecting the fluid flow nails into an associated irrigation conduit or pipe.

As such, it may be appreciated that there continues to be a need for a new and improved emitter gun apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of nailing gun apparatus now present in the prior art, the present invention provides an emitter gun apparatus wherein the same projects barbed nails into a pipe to permit fluid flow from the pipe through each associated emitter nail. As such, the general purpose of the present invention, which will be described subsequently in greater detail, is to provide a new and improved emitter gun apparatus which has all the advantages of the prior art nailing gun apparatus and none of the disadvantages.

To attain this, the present invention provides an apparatus for directing fluid emitters into an irrigation pipe, wherein the emitter includes a magazine aligning the emitter nails in a longitudinally aligned parallel relationship, including a hammer operative through a piston to sequentially project emitter nails into an underlying pipe. The pipe is mounted upon a "J" shaped support anvil, wherein the anvil may optionally further include a foot member mounted upon a slide mounted to a forward wall of a housing of the apparatus to provide frictional retention of the pipe during assembly of the emitter nails and the pipe.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved emitter gun apparatus which has all the advantages of the prior art nailing gun apparatus and none of the disadvantages.

It is another object of the present invention to provide a new and improved emitter gun apparatus which may be easily and efficiently manufactured and marketed.

It is a further object of the present invention to provide a new and improved emitter gun apparatus which is of a durable and reliable construction.

An even further object of the present invention is to provide a new and improved emitter gun apparatus which is susceptible of a low cost of manufacture with regard to both materials and labor, and which accordingly is then susceptible of low prices of sale to the consuming public, thereby making such emitter gun apparatus economically available to the buying public.

Still yet another object of the present invention is to provide a new and improved emitter gun apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic top view of the actuator lever utilized by the invention.

FIG. 6*a* is an orthographic side view of the actuator lever utilized by the invention.

FIG. 7 is an orthographic top view of the lift lever utilized by the invention.

FIG. 7*a* is an orthographic side view of the lift lever utilized by the invention.

DESCRIPTION OF THE PREFERRED EMBODIMENT

Figure 1:
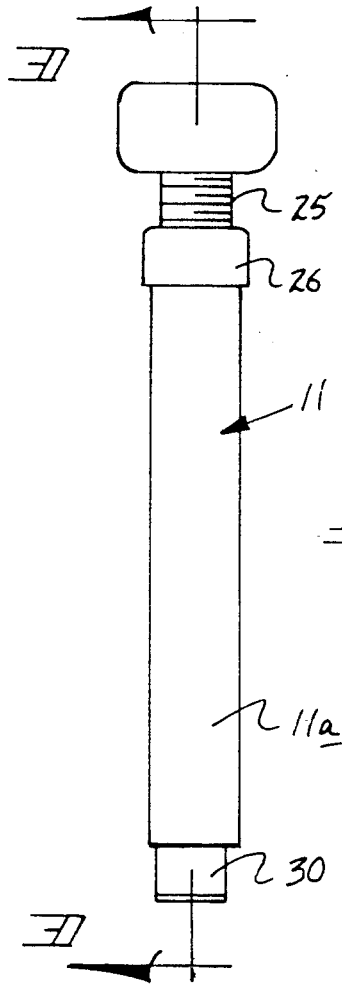
FIG. 1 is an orthographic front view, taken in elevation, of the emitter gun.
Figure 2:
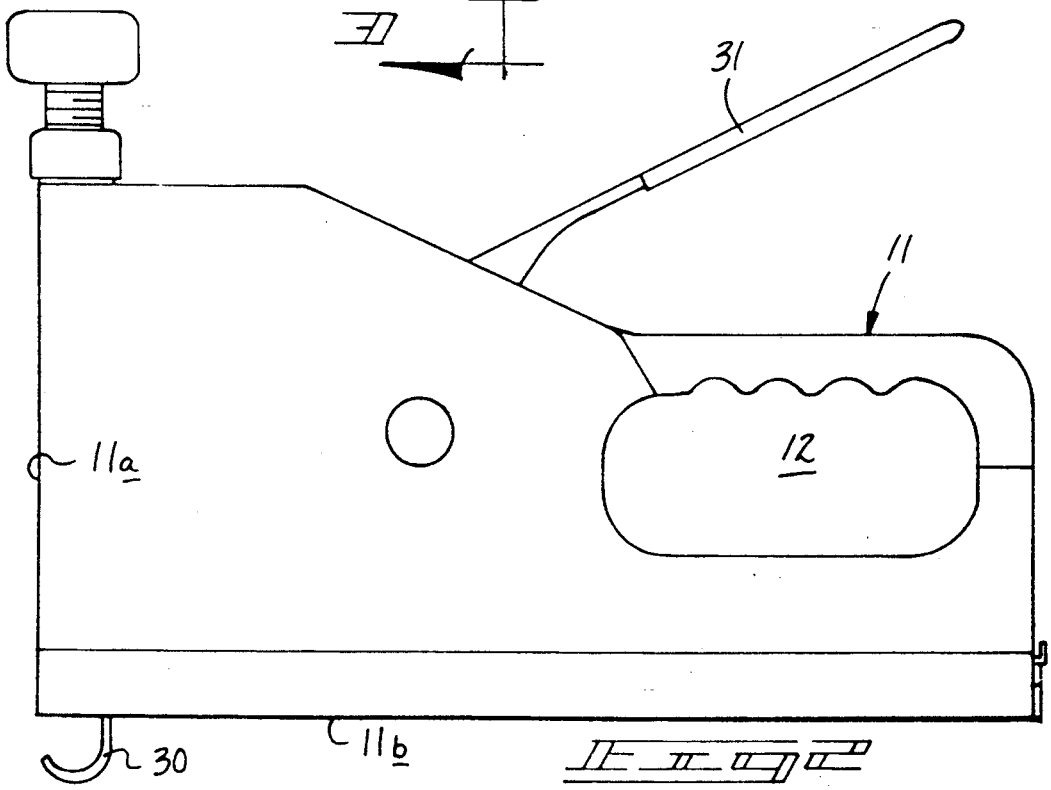
FIG. 2 is an orthographic side view, taken in elevation, of the emitter gun.

With reference now to the drawings, and in particular to FIGS. 1 to 11 thereof, a new and improved emitter gun apparatus embodying the principles and concepts of the present invention and generally designated by the reference numeral 10 will be described.

Figure 3:
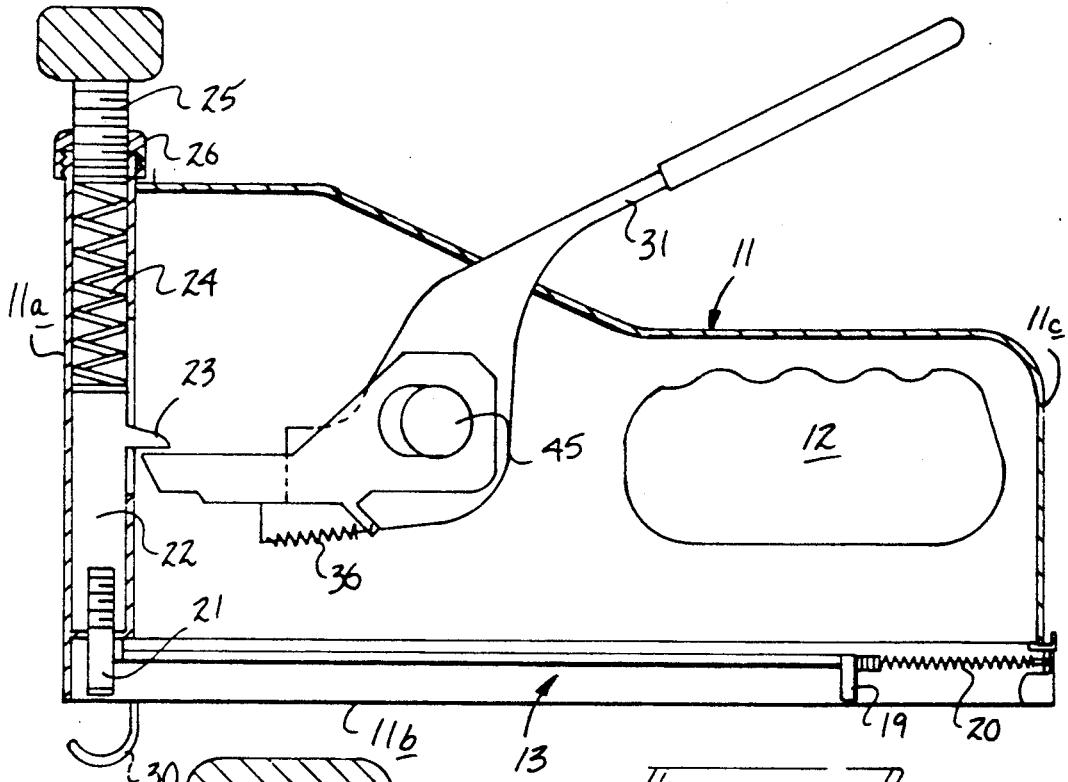
FIG. 3 is an orthographic cross-sectional illustration, taken along the lines 3—3 of FIG. 1 in the direction indicated by the arrows.
Figure 4:
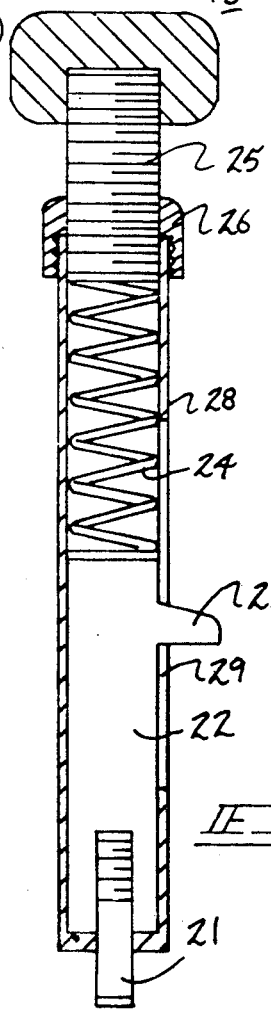
FIG. 4 is an orthographic frontal view of the guide housing mounting the piston and hammer therewithin.
Figure 5:
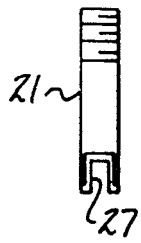
FIG. 5 is an orthographic view of the hammer structure utilized by the invention.
Figure 10:
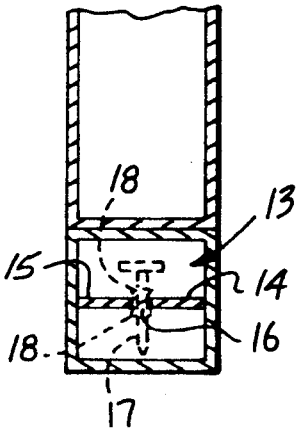
FIG. 10 is an orthographic view, taken along the lines 10—10 of FIG. 8 in the direction indicated by the arrows.
Figure 11:
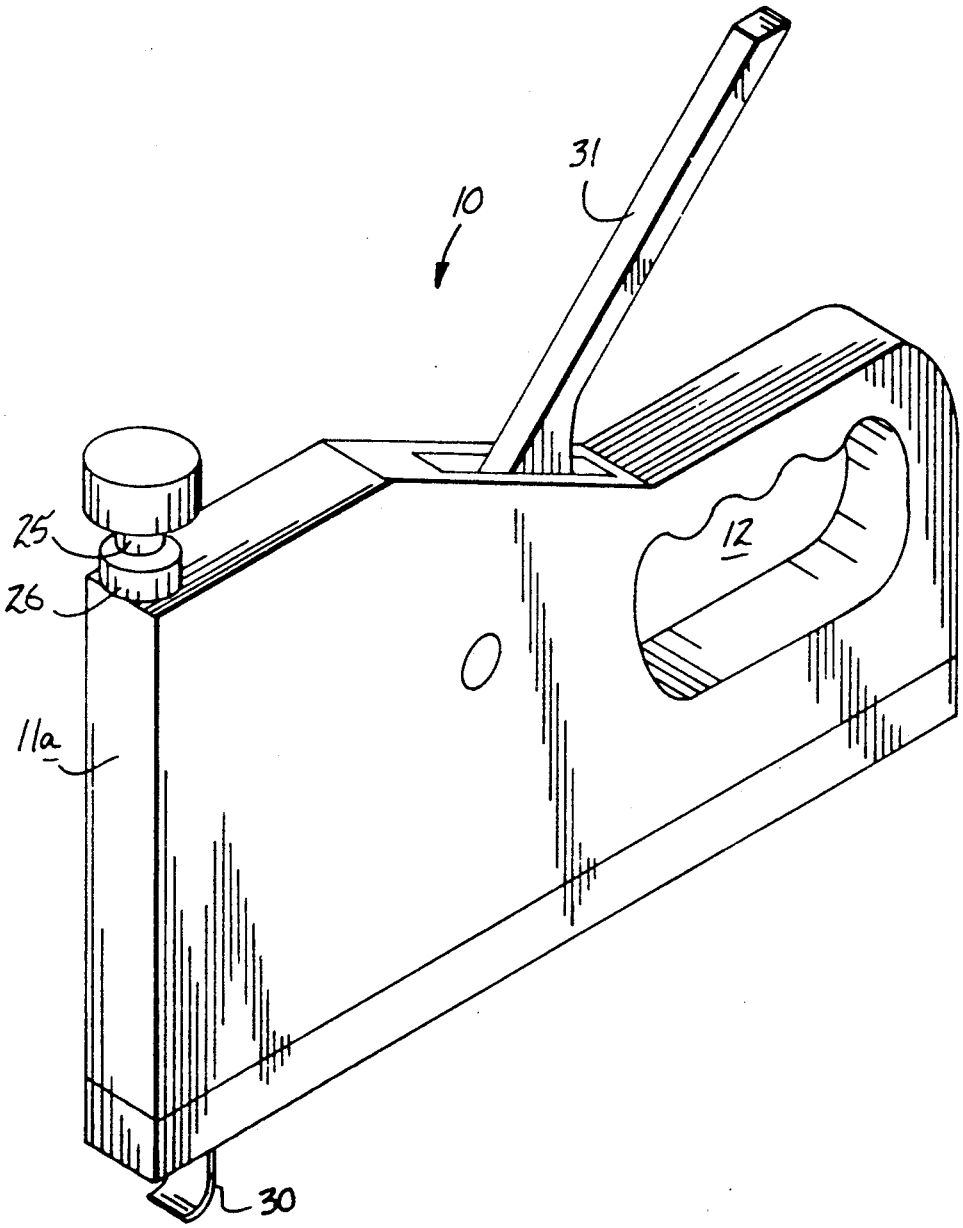
FIG. 11 is an isometric illustration of the instant invention.

More specifically, the emitter gun apparatus 10 of the instant invention essentially comprises a housing 11, including a handle opening 12 directed orthogonally through side walls of the housing, with the housing including a housing forward wall 11*a*, a housing bottom wall 11*b*, a housing rear wall 11*c*, and a top wall of a generally serpentine configuration extending from the forward wall to the rear wall. A magazine channel 13 is arranged parallel to the planar bottom wall 11*b* adjacent thereto and includes a plurality of coplanar first and second flange plates 14 and 15 that define a slot 16 continuously therebetween. The slots 16 are arranged to secure a fluid emitter nail 17 within the slot as the fluid emitter nails, as illustrated in FIG. 10, include spaced nail barbs 18, wherein a gap between the nail barbs is directed to ride within the slot 16. A presser foot 19 projects to a rearwardmost nail of a series of nails, as illustrated in FIG. 3, with the presser foot 19 projected forwardly by a presser foot spring 20.

A hammer 21 is orthogonally oriented relative to the bottom wall 11*b* and is mounted fixedly and threadedly to a lower terminal end of a piston 22. The piston 22 is slidably guided within a cylindrical guide housing 28, with the cylindrical housing 28 including a guide housing slot 29 projecting through a side wall thereof and wherein the piston 22 includes a piston flange 23 projecting through the guide housing slot 29. A piston spring 24 biases the piston in a downward orientation, with an externally threaded adjuster boss 25 imposing upon the spring and threadedly received within an internally threaded plug boss 26 to vary tension upon the piston 22 in its projection downwardly to impact an emitter nail. The piston 22 is raised by means of an actuator lever 31 mounted to a lift lever 32. The actuator lever and lift lever 32 are of separable parts and components, but it is understood that may be of a unitary construction to merely lift the piston by means of the piston flange 23, wherein the actuator lever 31 is pivoted about a support axle 45 orthogonally oriented relative to the side walls of the housing, wherein an actuator lever cavity 31*a* mounts the lift lever 32, wherein the lift lever 32 includes a support plate 33 positioned medially between spaced parallel guide flanges 34 that ride and are guided to each side of the cylindrical guide housing 28 to maintain alignment of the lift lever relative to the guide housing. A spring flange 35 projecting rearwardly of the support plate 33 mounts a spring 36 to maintain the lift lever in a lowered position, as illustrated. Upon pivotment of the actuator lever, the lift lever 32 is directed upon a bottom surface of the piston flange 23 and upon sufficient pivotment of the lift lever, the piston flange 23 passes forwardly of the support plate 33 to release the piston 22 and permit projection of the hammer 21 downwardly upon an emitter nail. The hammer member 21 includes a concave recess 27 to receive the nail 17 therewithin.

Figure 9:
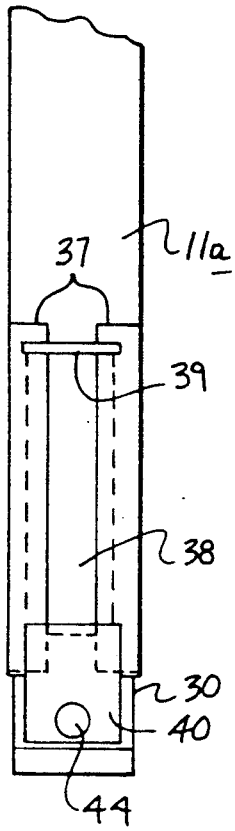
FIG. 9 is an orthographic view, taken along the lines 9—9 of FIG. 8 in the direction indicated by the arrows.
Figure 8:
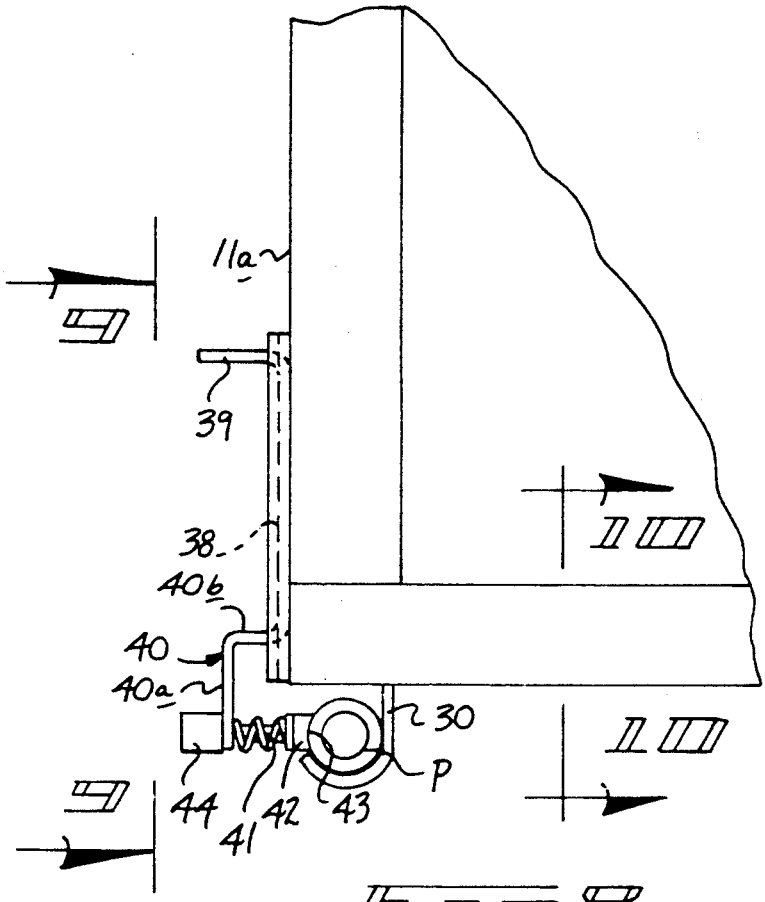
FIG. 8 is an orthographic side view of a modified housing structure utilizing a positioning structure to enhance orientation of the irrigation pipe relative to the support anvil.

A "J" shaped support anvil 30 is fixedly and orthogonally mounted to the bottom wall 11*b* to provide a concave cavity or recess to receive a pipe "P" (see FIG. 8) in alignment below the hammer 21. A modification of the invention, as illustrated in FIGS. 8-10, utilize a plurality of spaced track flanges 37 mounted to the forward wall 11*a* slidably mounting a slide plate 38 therewithin. The slide plate 38 includes a slide plate handle 39 fixedly mounted to an upper terminal end of the slide plate to permit vertical adjustment of the slide plate relative to the forward wall, wherein the slide plate 38 includes an "L" shaped positioning bracket 40 fixedly mounted to a lower terminal end thereof. The positioning bracket includes a bracket first leg 40*a* and a bracket second leg 40*b*, wherein the first leg 40*a* is parallel to and spaced from the slide plate positioned therebelow, wherein the second leg 40*b* is orthogonally oriented to the first leg 40*a* and to the lower terminal end of the slide plate 38. The first leg 40*a* slidably and orthogonally mounts a plunger rod 41 therethrough. The plunger rod 41 includes a foot member 42 mounted at a forward end of the plunger rod, with the head member 44 mounted to a rear terminal end of the plunger rod, wherein the foot member and head member are positioned on opposed sides of the second leg 40*b*. A plunger rod spring is captured between the first leg 40*a* and the foot member 42 to bias the foot member in a forward orientation to secure a pipe "P" in a sliding relationship within the "J" shaped anvil 30. The foot member 42 further includes an arcuate concave face 43 for confrontation with the pipe member "P" to maintain alignment with the pipe member "P" within a "J" shaped anvil 30. In this manner, the pipe member "P" is slidable orthogonally relative to the housing 11, wherein a series of emitter nails 17 are sequentially projected into the pipe "P" for use in fluid irrigation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An emitter gun apparatus, comprising, a housing, the housing including spaced parallel side walls, a housing forward wall, a bottom wall orthogonally intersecting the forward wall, and a rear wall spaced from the forward wall, and a top wall, and a magazine channel directed through the housing adjacent the bottom wall, the magazine channel including a plurality of nail members mounted therewithin, and hammer means for impacting a nail member mounted within the housing orthogonally intersecting the magazine channel at a forward end of the magazine channel, and an actuator lever directed through the top wall pivotally mounted within the housing for lifting the hammer means relative to the magazine channel, and the hammer means includes a hammer member, the hammer member including a hammer member lower terminal end, with the hammer member lower terminal end defining a concave recess positioned therewithin to receive the nail member therewithin, and the hammer member fixedly and coaxially aligned with a piston, the piston slidably received within a cylindrical guide housing, the cylindrical guide housing is fixedly mounted within the housing coextensively with the forward wall, and the cylindrical guide housing including a guide housing slot projecting through the guide housing diametrically opposed to the forward wall, and the piston including a piston flange projecting through the slot, and the actuator lever cooperative with the piston flange to raise the piston flange and piston upon pivotment of the actuator lever, and a piston spring coaxially aligned with the piston positioned to an upper end thereof within the cylindrical guide housing, and an externally threaded adjuster boss mounted to an upper terminal end of the spring to effect selective compression of the spring relative to the piston, and an internally threaded boss plug mounted to an upper terminal end of the cylindrical guide housing adjacent a first intersection defined by the housing top wall and the housing forward wall, and the actuator lever includes a lift lever mounted to the actuator lever, wherein the lift lever includes a support plate, the support plate positioned below and in contiguous communication with the piston flange when the actuator lever is in a raised position, and the support plate separated from the piston flange when the actuator lever is in a lowered second position, and a plurality of spaced parallel guide flanges orthogonally mounted to opposed sides of the support plate, wherein the guide flanges slidably receive the cylindrical guide housing therebetween to guide the lift lever relative to the guide housing, and including a J-shaped support anvil orthogonally mounted to the housing bottom wall positioned below the hammer to accommodate a cylindrical pipe member within the J-shaped anvil.

2. An apparatus as set forth in claim 1 including a plurality of spaced parallel track flanges mounted fixedly to the housing forward wall, and a slide track slidably mounted within the track flanges in contiguous communication with the housing forward wall, and the slide plate including a slide plate lower terminal end, the slide plate lower terminal end including an "L" shaped positioning bracket fixedly mounted to the slide plate lower terminal end, the positioning bracket including a first leg spaced from and parallel the slide plate positioned below the slide plate lower terminal end, and a second leg orthogonally mounted to the first leg and to the slide plate lower terminal end, and the first leg including a plunger rod slidably and orthogonally mounted through the first leg, and the plunger rod orthogonally oriented relative to the "J" shaped support anvil, and the plunger rod including a plunger rod head spaced on a forward side of the first leg, and a plunger rod foot member mounted to a rear side of the first leg, wherein the plunger rod includes a plunger rod spring captured between the foot member and the first leg, and the foot member includes a concave face for complementarily receiving the pipe therewithin.

* * * * *